United States Patent [19]

Froehlig

[11] 4,119,198

[45] Oct. 10, 1978

[54] PHONOGRAPH RECORD ALBUM OR SIMILAR ITEM

[75] Inventor: Rudolph A. Froehlig, College Point, N.Y.

[73] Assignee: Modern Album and Finishing Co., Inc., Hauppauge, N.Y.

[21] Appl. No.: 657,253

[22] Filed: Feb. 11, 1976

Related U.S. Application Data

[63] Continuation of Ser. No. 530,090, Dec. 6, 1974, abandoned, which is a continuation of Ser. No. 280,053, Aug. 11, 1972, abandoned.

[51] Int. Cl.[2] ..... B65D 85/30

[52] U.S. Cl. ..... 206/312

[58] Field of Search ..... 229/68 R, 87 R; 206/311–313

[56] References Cited

U.S. PATENT DOCUMENTS

| | | | |
|---|---|---|---|
| 3,061,086 | 10/1962 | Smiler | 206/312 |
| 3,061,171 | 10/1962 | Garrod et al. | 206/312 X |
| 3,199,768 | 8/1965 | Farmlett | 229/68 R |
| 3,232,423 | 2/1966 | Smiler | 206/312 |

FOREIGN PATENT DOCUMENTS

| | | | |
|---|---|---|---|
| 386,226 | 4/1965 | Switzerland | 229/68 R |
| 910,770 | 11/1962 | United Kingdom | 206/312 |

*Primary Examiner*—Stephen Garbe

*Attorney, Agent, or Firm*—Holland, Armstrong, Wilkie & Previto

[57] ABSTRACT

A phonograph record album with an outer sheet having informational material printed thereon. The sheet is folded over the base jacket so that it covers both sides of the jacket. This is done in an automatic machine which applies half the sheet to one side and then reverses itself to apply half to the other side.

1 Claim, 12 Drawing Figures

Fig. 1.
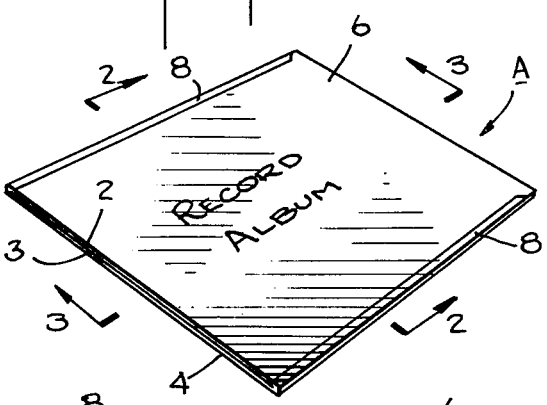
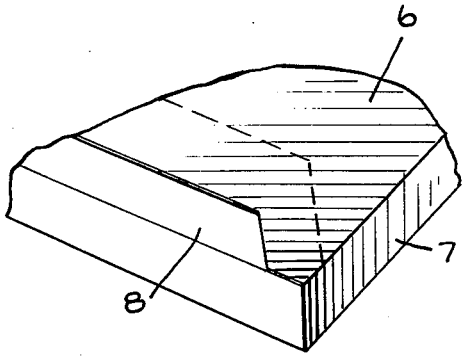
Fig. 6.
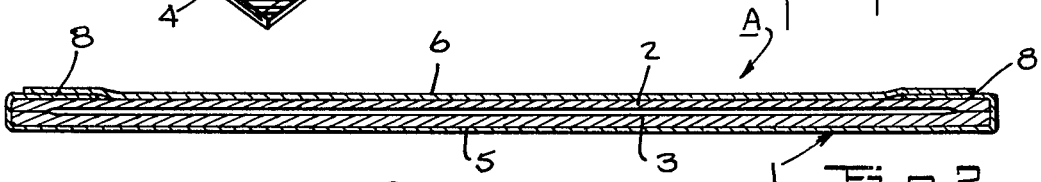
Fig. 2.
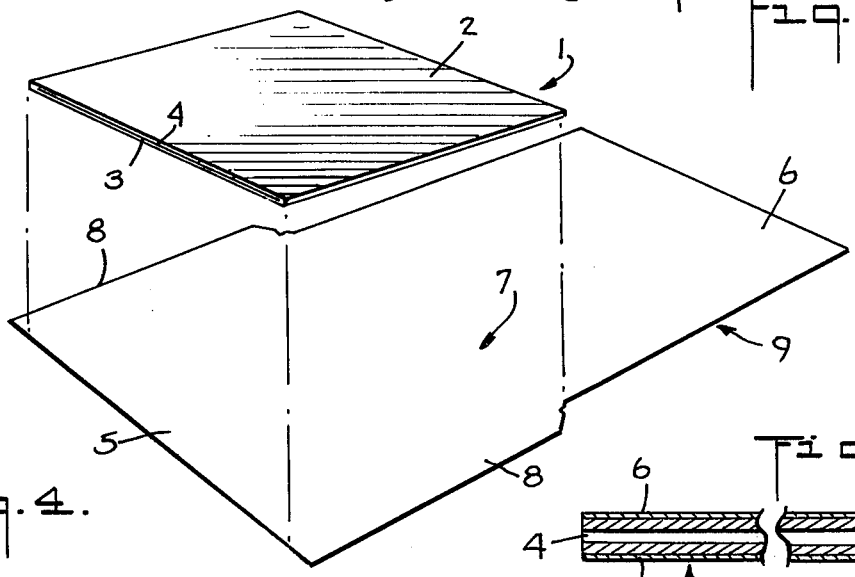
Fig. 4.
Fig. 3.
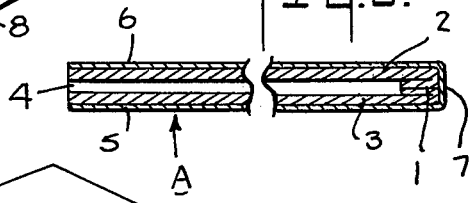
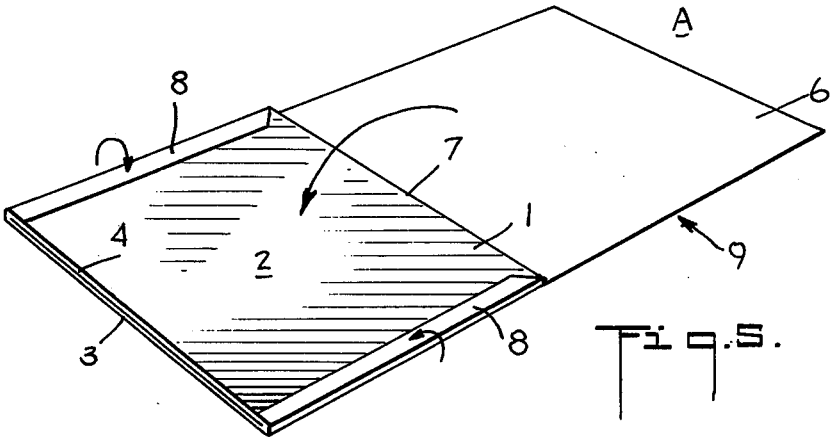
Fig. 5.

PHONOGRAPH RECORD ALBUM OR SIMILAR ITEM

DESCRIPTION

This application is a continuation of pending United States Application Ser. No. 530,090 filed Dec. 6, 1974, now abandoned which, in turn, is a continuation of Ser. No. 280,053 filed Aug. 11, 1972 now abandoned.

The present invention relates to a phonograph record album and more particularly to an improved phonograph record album which has descriptive material printed on it.

Phonograph record album jackets have, in the past, been made by two blank sheets of relatively thick paperboard to form a base jacket. An outer wrapper is provided over the thick paperboard which gives the details of the name of the artist and other informational material.

Heretofore, such informational material has been either lithographed on the paperboard itself or it has been necessary to place such information on two separate sheets which would then be adhered on each side of the base jacket.

The present invention overcomes this and provides an improved album and method of making it whereby the informational material can be put on a single separate sheet which is then wrapped around the paperboard base jacket.

Another object of the present invention is the provision of an improved method of wrapping the sheet around a base jaacket.

Another object of the present invention is the provision of an improved record album and a machine for producing it.

Another object of the present invention is the provision of an improved outer wrapper for use in forming a phonograph record album.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for purposes of illustration and description and is shown in the accompanying drawings, forming a part of the specification, wherein:

FIG. 1 is a perspective view of a phonograph record album made in accordance with the present invention;

FIG. 2 is a sectional view taken along line 2—2 of FIG. 1;

FIG. 3 is a sectional view taken along line 3—3 of FIG. 1;

FIG. 4 is an exploded view showing the first step in the method of wrapping the outer layer around the phonograph jacket;

FIG. 5 is a perspective view showing the next step;

FIG. 6 is a detail of a corner of the phonograph record jacket;

Figure 7:
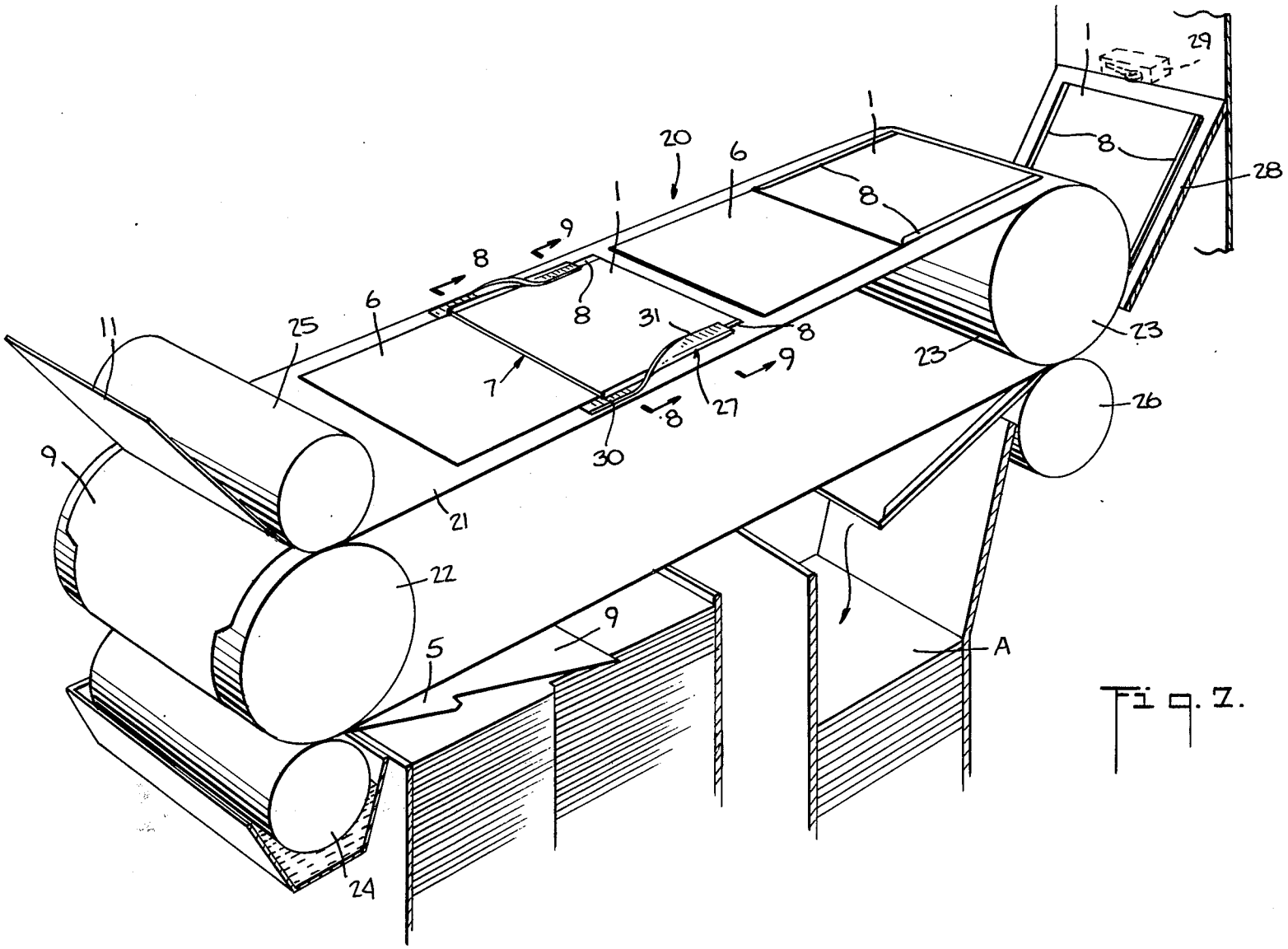
FIG. 7 is a schematic perspective view showing the machine for making the album of the present invention.

Referring to the drawings and more particularly to FIGS. 1 to 6, the phonograph record album A of the present invention comprises an inner base jacket 1 made of a pair of relatively thick paperboard panels 2 and 3 joined together along three edges by an adhesive and not joined together along the fourth edge to form a mouth 4 for the phonograph record.

An outer relatively thin flexible sheet 9 having informational material printed on one side thereof is wrapped around the inner base jacket 1. The outer sheet 9 has a pair of panels 5 and 6 joined together along a fold line 7. The panel 5 is provided with an outer flap 8 along each edge thereof. The outer sheet 9 is wrapped around the inner base jacket 1 by first applying an adhesive to the inner face of the outer sheet 9 and adhering the sheet panel 5 to the jacket panel 3 (FIG. 4). The flaps 8 are then wrapped around the side edges of the inner base jacket 1 so that they overlap slightly the jacket panel 2 thereof. The second sheet panel 6 is then folded over along the fold line 7 so that it adheres to jacket panel 2 and its side edges are superimposed over the flaps 8, as shown in FIG. 6, to complete the album A.

FIGS. 7 to 12 show a machine 20 which may be used for performing the method described above. The machine 20 has a conveyor belt 21 driven by rollers 22 and 23. An adhesive-applying roller 24 is mounted below the first roller 22 and a pressure feed roller 25 is mounted above it. A second pressure-applying roller 26 is mounted below and adjacent to the second roller 23. Folding bar elements 27 are mounted along the conveyor 21. There is a ramp 28 at the end of the conveyor belt and a reverse moving switch mechanism 29 at the end of the ramp 28.

The outer sheets 9 are stacked below the conveyor roller 22 and the finished albums A are deposited below the conveyor roller 23.

The inner base jackets 1 are supplied to the pressure roller 25 by a feed mechanism which is not shown. They are fed with the mouths facing the ramp 28. The printed outer sheet 9 which is stacked below the conveyor is fed upwardly by a feeding mechanism, not shown, and is wrapped around the drive roller after it comes into contact with the adhesive roller 24 which coats the entire sheet's inner surface with an adhesive.

Figure 8:
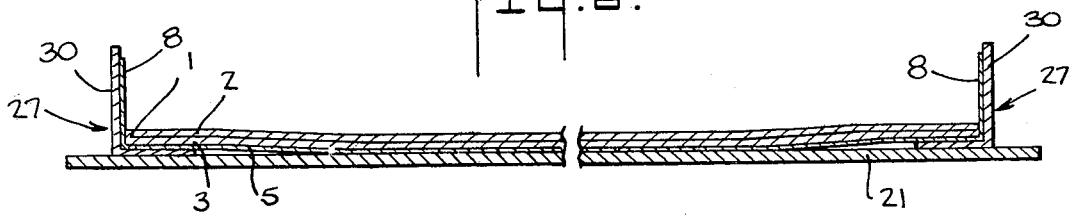
FIG. 8 is a sectional view along line 8—8 of FIG. 7.
Figure 9:
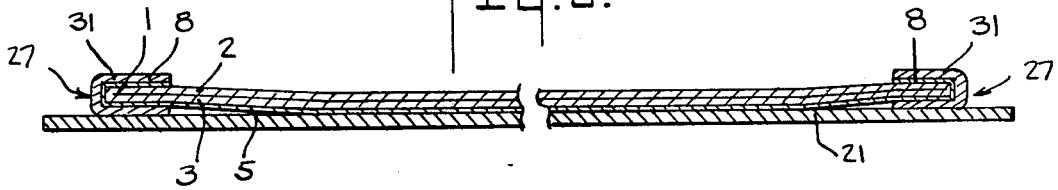
FIG. 9 is a sectional view taken along line 9—9 of FIG. 7.
Figure 10:
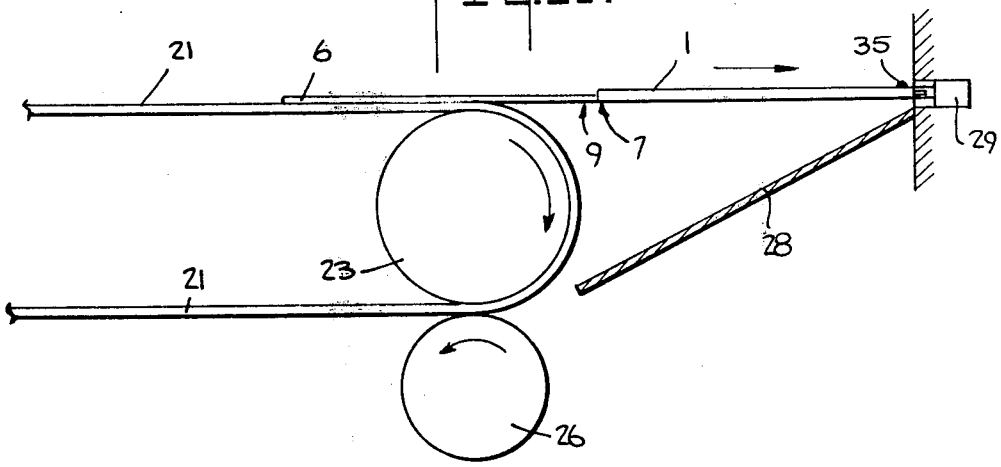
FIG. 10 is a detail of the end of the machine showing a reverse tripping mechanism.

The pressure roller 25 then feeds the inner base jacket 1 so that one panel 3 of the jacket is adhered to the panel 5 of the sheet 9. The conveyor 21 then moves the adhered jacket-sheet combination below the flap-turning members 27 which bend the flaps 8 over the edge, as shown in FIGS. 8 and 9. The turning mechanism 27 comprises a pair of upright rails 30 on either side of the conveyor which become and merge into flat, horizontal rails at 31 in order to turn the flaps 8 over.

Figure 11:
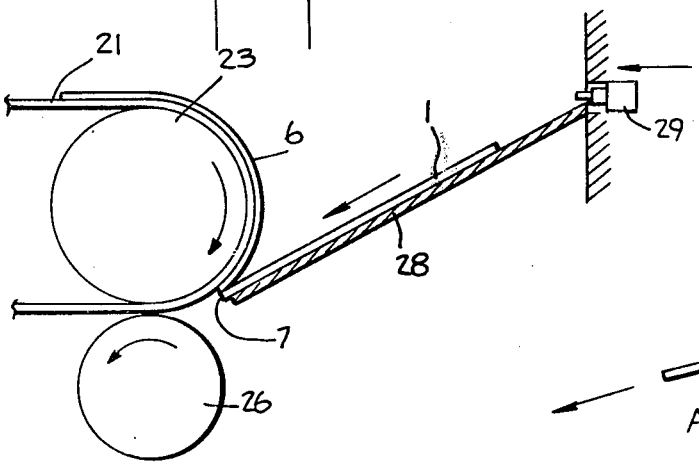
FIG. 11 is a detail similar to FIG. 10 showing the album being placed in a reverse direction.
Figure 12:
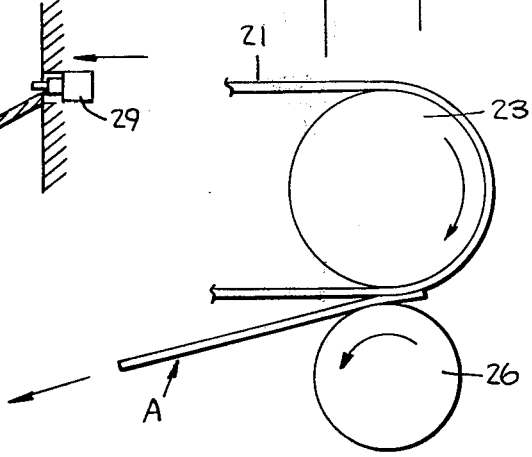
FIG. 12 is a detail showing the finished album.

The entire jacket-sheet combination is then moved to the end of the conveyor 21 where the forward movement is continued by the conveyor 21 to cause the leading edge 35 (where the mouth is) of the inner jacket 1 to strike switch assembly 29. This causes the switch assembly mechanism 29 to move the jacket 1 backwardly against the direction of the conveyor 21 and downwardly (FIG. 11) so that the flexible outer sheet 9 buckles along the fold line 7. The folding sheet 9 and the jacket 1 are then moved under a pressure roller 26, as shown in FIGS. 11 and 12, and the continued backward movement adheres the panel 6 of the flexible sheet 9 to the panel 3 of the inner jacket 1. The finished product is then deposited in a bin 35.

It will thus be seen that the present invention provides an improved album and method of making it whereby the informational material can be put on a single separate sheet which is then wrapped around the paperboard and an improved method and machine for wrapping the sheet around an album.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A container comprising an inner jacket having a pair of separate superimposed flat panels sealed along the rear and side edges and being open at the front, the rear edge of the panels being sealed to each other by means of integral lips extending from the rear edge of each panel and folded inwardly in superimposed relation to its panel and the lips being superimposed on each other and adhered to each other, a thin flat one piece outer blank having a pair of panels having writing thereon connected together by a fold line wrapped around said inner jecket, the panels of the inner jacket having a substantially greater thickness than the thickness of the outer blank and being devoid of writing, the first panel of the outer blank adhered to a first panel of the jacket, the second panel of the outer blank folded around the fold line along the rear edge of the inner jacket and being adhered to the second panel of the inner jacket, side flaps extending from the first panel of the blank, said flaps being bend over the side edges of the inner jacket and adhered to the said second panel of the inner jacket below the second panel of the blank, the width of said second panel of the outer blank being narrower than the width of the second panel on said inner jacket to form side edges spaced inwardly from the side edge of the inner jacket, a zone adjacent said side edges being adhered to the said bent flaps and the free edges of the outer blank terminating at the open front of the inner jacket.

* * * * *